US006938288B2

(12) United States Patent
Hunter et al.

(10) Patent No.: US 6,938,288 B2
(45) Date of Patent: Sep. 6, 2005

(54) CONVERSION KIT FOR TURNING A CROSS-LEGGED FOLDING COT INTO A TIERED COT

(76) Inventors: Robert James Hunter, P.O. Box 6724, Bonnyville, Alberta (CA), T9N 2H2; Catherine Joan Hunter, P.O. Box 6724, Bonnyville, Alberta (CA), T9N 2H2

( * ) Notice: Subject to any disclaimer, the term of this patent is extended or adjusted under 35 U.S.C. 154(b) by 0 days.

(21) Appl. No.: 10/889,517

(22) Filed: Jul. 12, 2004

(65) Prior Publication Data

US 2005/0011002 A1 Jan. 20, 2005

(30) Foreign Application Priority Data

Jul. 16, 2003 (CA) ..... 2435453

(51) Int. Cl.[7] ..... A47C 17/64; A47C 19/20

(52) U.S. Cl. ..... 5/114; 5/110; 5/8

(58) Field of Search ..... 5/114, 115, 117, 5/112, 110, 8, 9.1, 11, 285, 656, 503.1, 658, 509.1

(56) References Cited

U.S. PATENT DOCUMENTS

| | | | | |
|---|---|---|---|---|
| 1,001,946 A | | 8/1911 | Gumm | |
| 1,359,637 A | | 11/1920 | Travis et al. | |
| 1,457,232 A | * | 5/1923 | Sheney | 5/114 |
| 1,561,797 A | | 11/1925 | Rumpel | |
| 1,567,786 A | | 12/1925 | Brandt | |
| 1,802,149 A | | 4/1931 | Holt | |
| 2,072,791 A | * | 3/1937 | Baer | 248/407 |
| 2,354,906 A | | 8/1944 | Bailey et al. | |
| 2,508,254 A | | 5/1950 | Ham | |
| 2,545,289 A | * | 3/1951 | Lang | 5/11 |
| 2,611,906 A | | 9/1952 | Backer | |
| 2,640,996 A | * | 6/1953 | Davis | 5/8 |
| 2,744,794 A | | 5/1956 | Sheard | |

(Continued)

FOREIGN PATENT DOCUMENTS

| | | |
|---|---|---|
| CH | 214 282 | 6/1941 |
| CH | 374 463 | 2/1964 |
| CH | 607 745 | 10/1978 |
| DE | 248 433 | 6/1912 |
| DE | 882 518 | 7/1953 |
| DE | 1 817 566 | 7/1970 |
| DE | 2 227 174 | 12/1973 |
| EP | 0 177 358 A2 | 4/1986 |
| FR | 763 827 | 5/1934 |
| FR | 853 586 | 3/1940 |
| FR | 1 106 605 | 12/1955 |
| FR | 1 216 130 A | 4/1960 |
| FR | 2 442 030 A1 | 6/1980 |
| FR | 2 600 884 | 1/1988 |
| GB | 387 043 | 2/1933 |
| GB | 496 506 | 12/1938 |
| GB | 546 173 | 7/1942 |
| GB | 647 880 | 12/1950 |
| GB | 753 842 | 8/1956 |
| GB | 872 914 | 7/1961 |
| SE | 189 916 A | 6/1964 |

*Primary Examiner*—Robert G. Santos
(74) *Attorney, Agent, or Firm*—Christensen O'Connor Johnson Kindness PLLC

(57) ABSTRACT

A kit for converting a cross-legged folding cot into a tiered cot, which stilt legs having a longitudinal axis, a top end and a bottom end. A female coupling is positioned at the top end of each of the stilt legs. Each female coupling is offset from the longitudinal axis by between 45 degrees and 65 degrees, and is adapted to receive a leg from a first cross-legged folding cot. With each female coupling holding a leg of a first cross-legged folding cot, the first cot is effectively elevated, such that gear can be stowed or a second cot can be positioned in the space provided beneath the first cot between the stilt legs.

10 Claims, 5 Drawing Sheets

U.S. PATENT DOCUMENTS 2,841,803 A 7/1958 Bodling
2,853,716 A * 9/1958 Sevcik ..... 5/8
2,901,124 A 8/1959 Gingher et al.
2,924,830 A * 2/1960 De Long ..... 5/8
3,007,180 A * 11/1961 Zaugg ..... 5/625
3,104,401 A 9/1963 Davis
3,105,976 A * 10/1963 Roche ..... 5/285
3,426,367 A 2/1969 Bradford
3,463,265 A 8/1969 Clover
3,886,606 A 6/1975 Bradford
3,965,502 A 6/1976 Bertram
3,967,327 A 7/1976 Severson
4,034,518 A * 7/1977 Trecker ..... 5/114
4,051,564 A 10/1977 Gudish
4,801,176 A 1/1989 Wolberg
4,896,385 A 1/1990 Bustos
4,914,768 A 4/1990 Howard
4,958,390 A 9/1990 Mendenhall
5,003,649 A 4/1991 Kelly
5,109,556 A 5/1992 Cook
5,210,888 A 5/1993 Canfield
5,301,377 A 4/1994 Kim
5,461,735 A 10/1995 Danton
5,555,576 A 9/1996 Kim
6,098,218 A 8/2000 Ventura
6,148,459 A * 11/2000 Verhulst ..... 5/503.1
6,233,765 B1 * 5/2001 Verhulst ..... 5/503.1
6,345,000 B1 * 2/2002 Wong et al. ..... 365/185.29
6,347,419 B1 * 2/2002 Kurtz ..... 5/503.1
6,353,945 B1 3/2002 Jannetides
6,513,178 B1 2/2003 Kelly et al.
6,564,400 B2 * 5/2003 Kelly et al. ..... 5/8
6,701,548 B2 * 3/2004 Vigneron ..... 5/110
6,704,952 B2 * 3/2004 Kurtz ..... 5/308
2001/0013145 A1 * 8/2001 Elliott et al. ..... 5/110
2003/0074733 A1 * 4/2003 Kelly et al. ..... 5/110
2003/0088914 A1 * 5/2003 Vigneron ..... 5/8
2003/0159214 A1 * 8/2003 Kurtz ..... 5/503.1
2004/0187206 A1 * 9/2004 Devlin ..... 5/2.1

* cited by examiner

CONVERSION KIT FOR TURNING A CROSS-LEGGED FOLDING COT INTO A TIERED COT

FIELD OF THE INVENTION

The present invention relates to a conversion kit for turning a cross-legged folding cot into a tiered cot, and such a tiered cot assembled using components from the conversion kit.

BACKGROUND OF THE INVENTION

Tiered cots, with one cot positioned above another cot, are well known. The following United States patents are examples of tiered: U.S. Pat. No. 3,104,401 (Davis 1963), U.S. Pat. No. 3,426,367 (Bradford 1969) and U.S. Pat. No. 3,967,327 (Severson 1976). The use of tiered cots enables more personnel or more gear to be positioned in a confined area, such as a tent, by taking advantage of available vertical space.

The most common form of cot presently in use is a cross-legged folding cot. The cross-legged folding cot has supplanted other cot configurations, due to their ability to fold into a relatively compact form. There is no known tiered cot configuration that uses cross-legged folding cots.

SUMMARY OF THE INVENTION

What is required is a kit for converting a cross-legged folding cot into a tiered cot.

According to the present invention there is provided a kit for converting a cross-legged folding cot into a tiered cot, which includes at least four stilt legs having a longitudinal axis, a top end and a bottom end. A female coupling is positioned at the top end of each of the at least four stilt legs. Each female coupling is offset from the longitudinal axis by between 45 degrees and 65 degrees, and is adapted to receive a leg from a first cross-legged folding cot. With each female coupling holding a leg of a first cross-legged folding cot, the first cot is effectively elevated such that a second cross-legged cot can be positioned in the space provided beneath the first cot between the stilt legs.

Although beneficial results have been obtained through the use of the kit for converting a cross-legged folding cot into a tiered cot as described above, the use of cross-bracing and the addition of two more stilt legs for a total of six stilt legs improves the stability of a tiered cot especially if it is larger in dimension or intended for heavier individuals.

Although beneficial results have been obtained through the use of the kit for converting a cross-legged folding cot into a tiered cot as described above, even more beneficial results may be obtained where the stilt legs are telescopically adjustable allowing for adjustments to the height of the first cot.

Although beneficial results have been obtained through the use of the kit for converting a cross-legged folding cot into a tiered cot as described above, even more beneficial results may be obtained where additional features are provided. The addition of a step adapted as a drink receptacle and the addition of hooks to the stilt legs improve the utility of the tiered cot. The further addition of a tarp with tie straps allows for the enclosure of the second cot on one side. Where the tarp is repositioned, it also functions as a back support for persons seated on the second cot.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
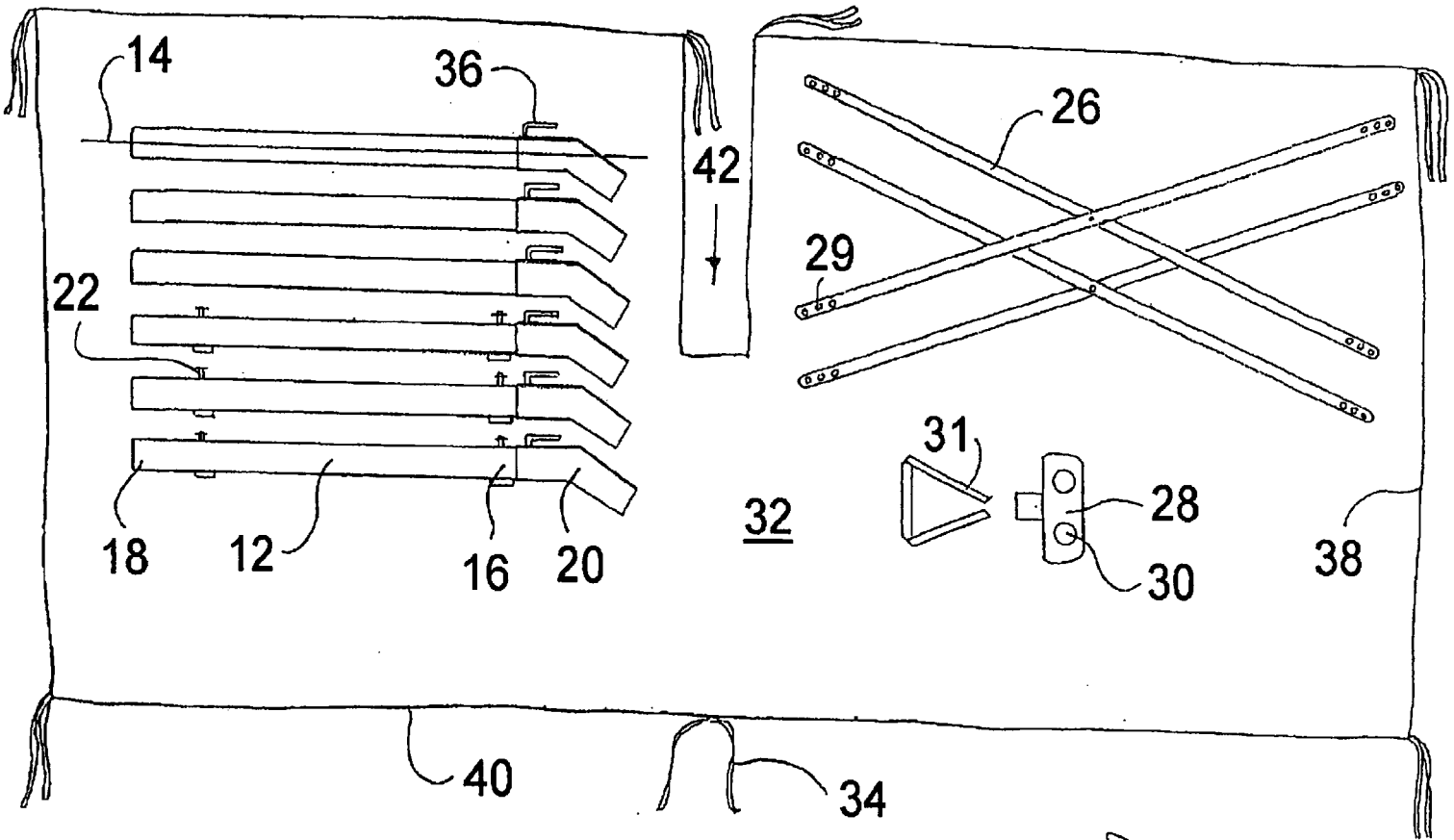
FIG. 1 is a top plan view of a kit for converting a cross-legged folding cot into a tiered cot in unassembled form according to the teachings of the present invention

The preferred embodiment, a kit for converting a cross-legged folding cot into a tiered cot generally identified by reference numeral 10, will now be described with reference to FIGS. 1 through 5.

Figure 5:
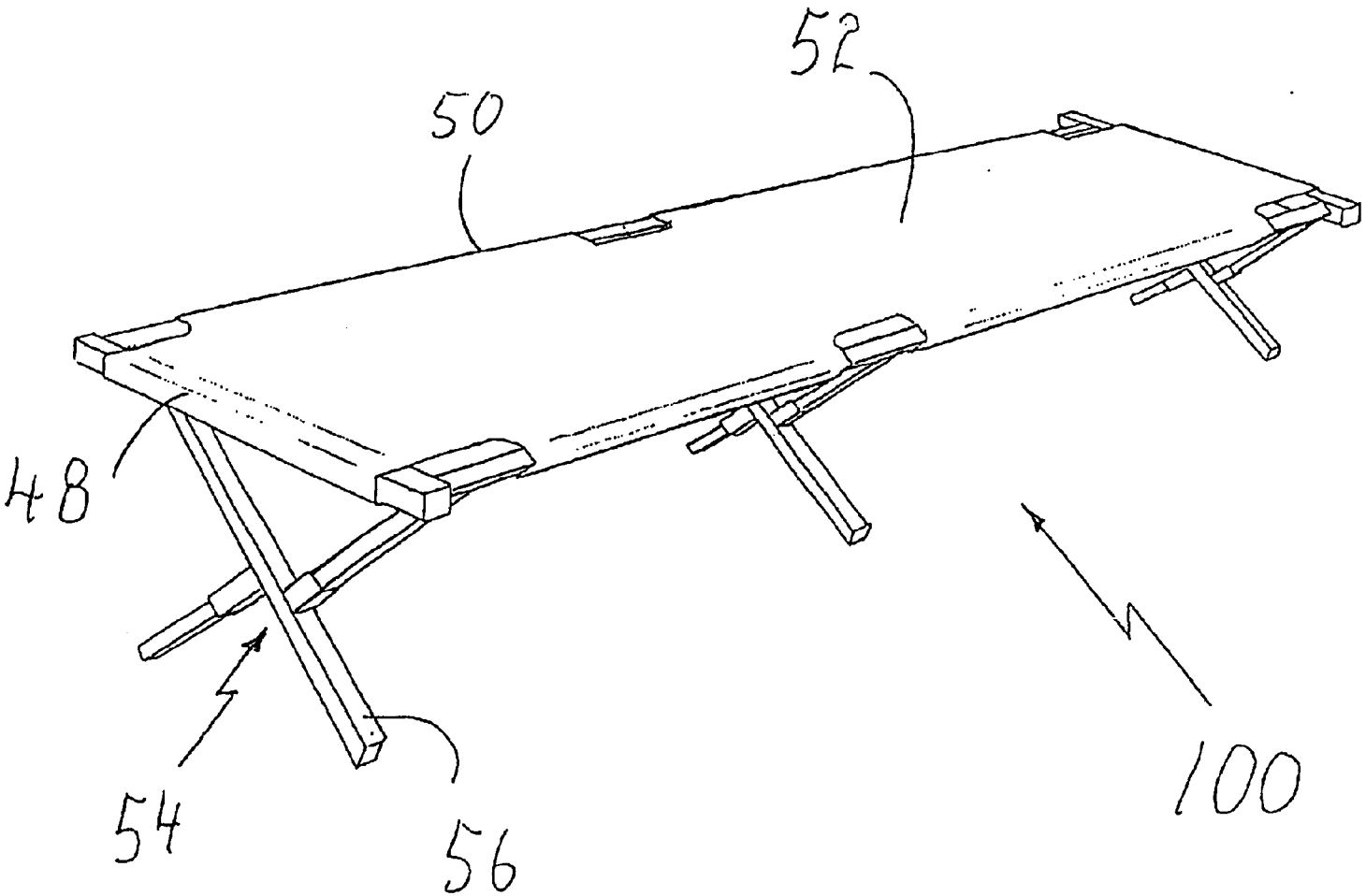
FIG. 5 labelled as PRIOR ART is a perspective view of a cross-legged folding cot.

In order to place the present invention in context there will first be described the cross-legged folding cots which kit 10 was designed to configure. Referring to FIG. 5, a cross-legged folding cot generally referred to as numeral 100 has two opposed ends 48, two opposed sides 50, a surface 52 and at least two cross-legged assemblies 54 each having two legs 56 which support surface 52. It will be appreciated that various methods of constructing cross-legged cots may exist. In the illustrated embodiment, cross-legged cot 100 utilizes canvas stretched over square tubing.

Figure 2:
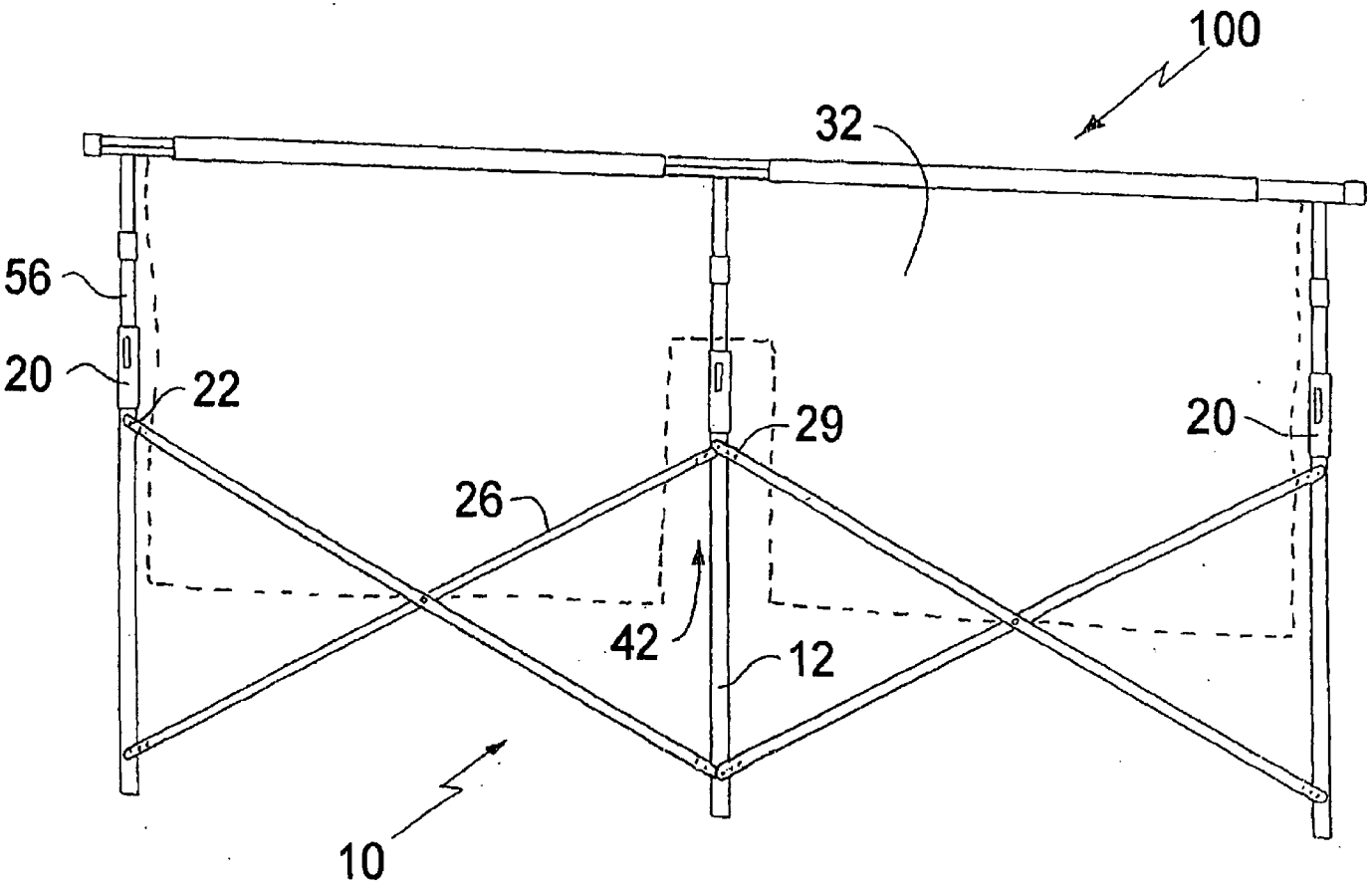
FIG. 2 is a rear elevation view of the kit illustrated in FIG. 1 elevating a first cross-legged folding cot.
Figure 3:
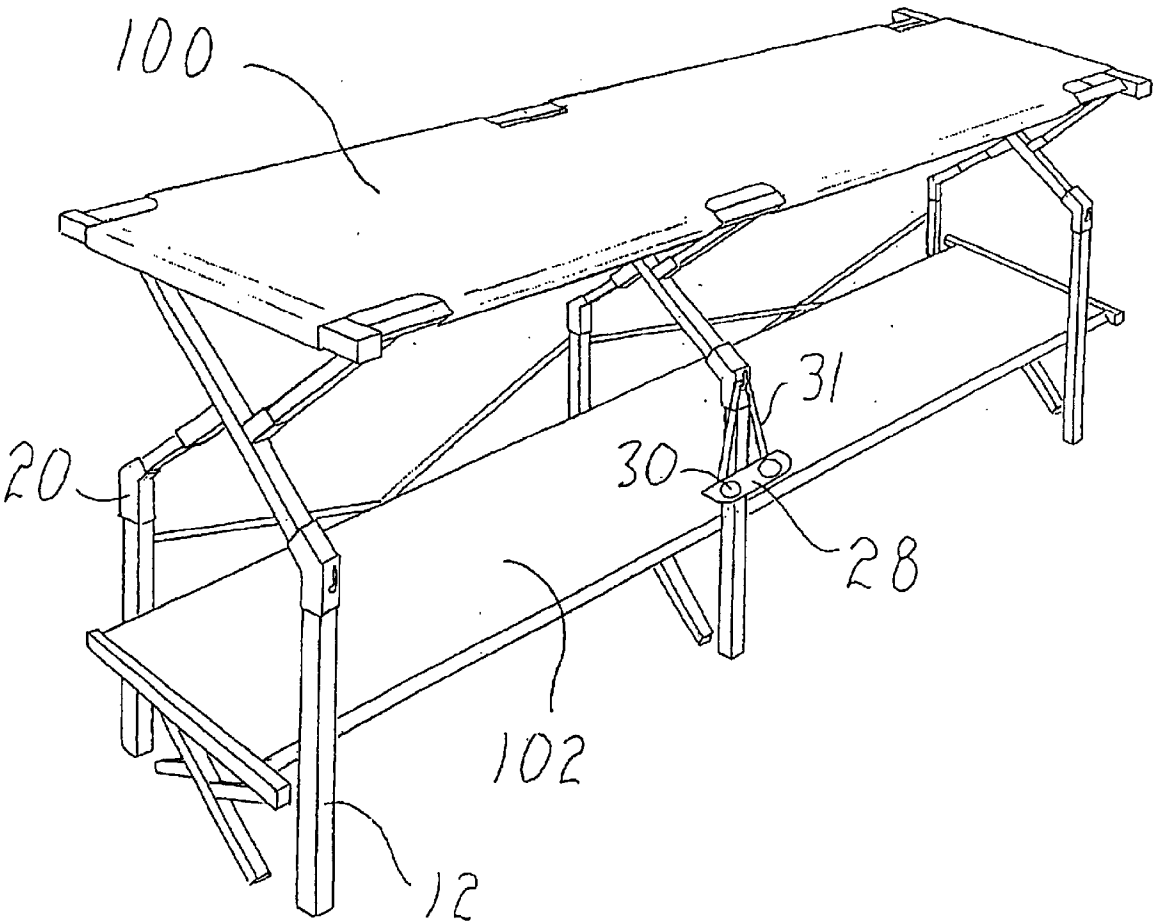
FIG. 3 is a perspective view of the kit illustrated in FIG. 1 in fully assembled form configuring two cross-legged folding cots.
Figure 4:
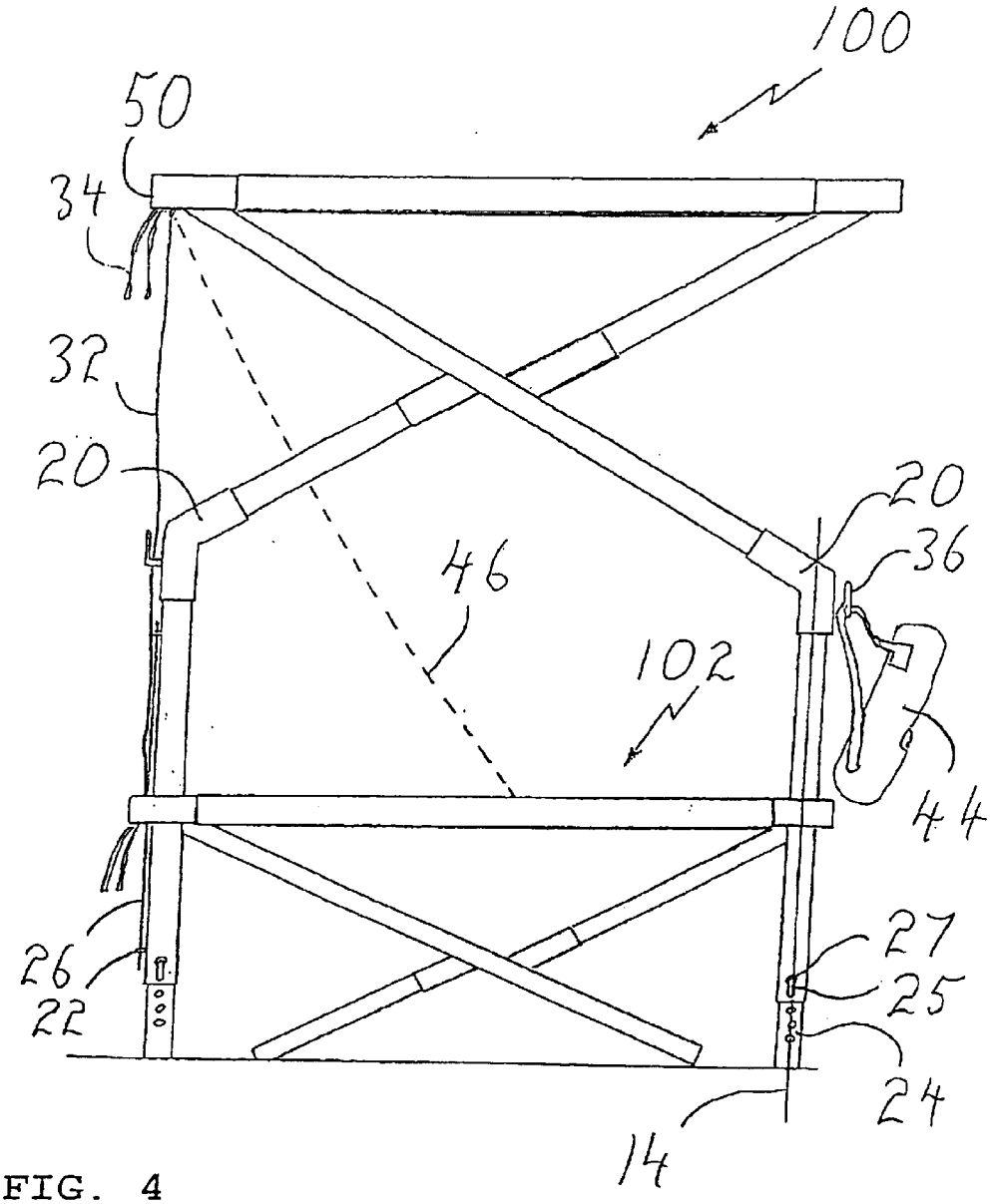
FIG. 4 is a side elevation view of the assembled kit illustrated in FIG. 3 with adjustable legs and a tarp.

Structure and Relationship of Parts:

Referring to FIG. 1, kit 10 includes at least four stilt legs 12 each having a longitudinal axis 14, a top end 16 and a bottom end 18. A female coupling 20 is positioned at top end 16 of each of stilt legs 12. Each of female couplings 20 is offset from longitudinal axis 14 by approximately by between 45 degrees and 65 degrees depending upon the make of cot. The more common offset is approximately 55 degrees. At least two of the at least four stilt legs 12 are adapted with attachment points 22. In the illustrated embodiment, six stilt legs 12 are shown, three being adapted with attachment points 22. Referring to FIG. 4, each of female couplings 20 is adapted to receive a leg 56 from a cross-legged folding cot 100. In the illustrated embodiment, stilt legs 12 may also be adapted with telescopically adjustable leg extensions 24. Leg extensions are secured in a selected telescopic position by pins 25 which engage aligned apertures 27. Referring to FIG. 3, stilt legs 12 are adapted such that, once configured, a second cross-legged cot 102 may be may be slid between stilt legs 12 and positioned underneath first cross-legged cot 100. Referring to FIG. 1, kit 10 further includes cross-bracing 26, a step 28 having at least one receptacle 30 adapted to serve as a drink holder, a tarp 32 with straps 34 and hooks 36 positioned on each of female couplings 20. In the illustrated embodiment, tarp 32 has a pair of parallel short sides 38, a pair of parallel long sides 40 and is adapted with a slot 42. Referring to FIG. 2, cross-bracing 26 attaches to attachment points 22 in a cross configuration. Referring to FIG. 1, multiple holes 29 are provided on cross-bracing 26, in order to accommodate different makes and sizes of cots. Slot 42 is adapted to accommodate an intermediate pair of stilt legs 12. Referring to FIG. 3, step 28 supported by strap 31 attaches to one of stilt legs 12 at a level convenient both for stepping and holding beverages in receptacles 30. Referring to FIG. 4, tarp 32 is attached with straps 34 tied to one of opposed sides 50 of first cross-legged folding cot 100 and either second crossed-legged folding cot 102 or the stilt legs 12. Hooks 36 are oriented upwards in alignment with longitudinal axis 14.

Operation:

The use and operation of a kit for converting a cross-legged folding cot into a tiered cot generally identified by reference numeral 10, will now be described with reference to FIGS. 1 through 5. Referring to FIG. 5, at least one of cross-legged cot 100 is provided. In the illustrated embodiment, a configuration forming a two tiered cot utilizing two cross-legged foldable cots will be described. Referring to FIG. 1, the various components of kit 10 are provided as shown and as described above. For the purposes of this description, a configuration with three pairs of stilt legs 12 (six stilt legs) will be described. Referring to FIG. 2, each pair of stilt legs is connected with cross-bracing 26 at attachment points 22. Each of legs 56 of cross-legged foldable cot 100 is fitted within each of female couplings 20 of each stilt leg 12 thereby elevating cot 100 to an upper tiered position. Referring to FIG. 3, once first cot 100 is elevated, second cot 102 may now be slipped between stilt legs 12 and positioned beneath first cot 100. Step 28 may also be attached. Step 28 is maintained in position through friction. However, as a safety measure, strap 31 is hooked over one of hooks 36 to ensure that no movement occurs. Referring to FIG. 4, tarp 32 is tied to one of two opposed sides 50 of first cot 100 and second cot 102, partially enclosing second cot 102. Items 44 may also be hung from hooks 36.

Variations:

Referring to FIG. 4, tarp 32 may be re-attached so as to form a second position 46. In this orientation, tarp 32 functions as a back support for persons seated on second cot 102. Referring to FIG. 2, slot 42 allows this variation by accommodating an intermediate pair of stilt legs 12 as shown. Referring to FIG. 4, a further variation is possible where stilt legs 12, adapted with telescopically adjustable extensions 24, are adjusted so as to vary the height of the two tiered cot assembly by adjusting the height of first cot 100 over second cot 102. This adjustment may be required to accommodate different sizes of individual, leave additional room to stow gear or, alternatively, to accommodate for uneven ground.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A conversion kit for turning a cross-legged folding cot into a tiered cot comprising:

at least four stilt legs having a longitudinal axis, a top end and a bottom end;

a female coupling positioned at the top end of each of the at least four stilt legs, the female coupling having an angled opening being offset from the longitudinal axis by between 45 degrees and 65 degrees, each female coupling being configured to receive a leg from a first cross-legged folding cot, such that the first cot is supported in an elevated position with the at least four stilt legs being substantially parallel to each other.

2. The conversion kit as defined in claim 1, wherein relative spacing of the at least four stilt legs is such that a second cross-legged folding cot can be slid beneath the first cot between the stilt legs.

3. The conversion kit as defined in claim 1, wherein there are six stilt legs.

4. The conversion kit as defined in claim 1, wherein each of the at least four stilt legs are telescopically adjustable in length.

5. The conversion kit as defined in claim 1, wherein cross-bracing is provided and attachment points are provided on at least two of the at least four stilt legs which are adapted for attachment to the cross-bracing.

6. The conversion kit as defined in claim 1, wherein a step attaches to one of the at least four stilt legs.

7. The conversion kit as defined in claim 6, wherein the step has at least one receptacle adapted to serve as a drink holder.

8. The conversion kit as defined in claim 1, wherein each of the at least four stilt legs has a hook from which gear may be suspended.

9. The conversion kit as defined in claim 2, wherein a tarp with tie straps is provided to enclose a first side of the first cot and a first side of the second cot.

10. The conversion kit as defined in claim 9, wherein the tarp is rectangular with a pair of parallel short sides and a pair of parallel long sides, a slot extends in from one of the long sides at an intermediate position equidistant between the short sides, the slot being adapted to accommodate one of the at least four stilt legs in order to facilitate the tarp being positioned angularly between the legs from the first side of the first cot to a second side of the second cot, in order to provide back support for a person seated on the second cot.

* * * * *